United States Patent [19]

Mikhail

[11] Patent Number: 5,005,698

[45] Date of Patent: Apr. 9, 1991

[54] INDIVIDUALLY WRAPPED CIGARETTES IN CIGARETTE PACK OR BOX

[76] Inventor: Ameer G. Mikhail, 945 Riverside Dr., Unit #15-A, Methuen, Mass. 01844

[21] Appl. No.: 568,294

[22] Filed: Jan. 5, 1984

[51] Int. Cl.[5] ..... B65D 85/10

[52] U.S. Cl. ..... 206/257; 206/820

[58] Field of Search ..... 206/257, 256, 258, 820, 206/390, 273

[56] References Cited

U.S. PATENT DOCUMENTS

| | | | |
|---|---|---|---|
| 1,830,571 | 11/1931 | Sullwald | 206/258 |
| 1,855,555 | 4/1932 | Miller | 206/631 |
| 2,023,542 | 12/1935 | Peck | 206/806 |
| 2,758,710 | 8/1956 | Arens | 206/390 |
| 3,107,782 | 10/1963 | Jaroff et al. | 206/820 |
| 3,162,539 | 12/1964 | Repko | 206/820 |
| 3,165,249 | 1/1965 | Peck | 206/820 |
| 3,249,212 | 5/1966 | Tamarin | 206/273 |
| 3,371,775 | 3/1968 | Butler | 206/258 |
| 3,409,721 | 11/1968 | Applezweig | 40/312 |
| 4,109,826 | 8/1978 | Maisonneuve | 426/115 |

FOREIGN PATENT DOCUMENTS

| | | | |
|---|---|---|---|
| 1953696 | 9/1979 | Fed. Rep. of Germany | 206/273 |
| 3006232 | 8/1981 | Fed. Rep. of Germany | 206/256 |

*Primary Examiner*—Stephen Marcus

[57] ABSTRACT

The common cigarettes in cigarette packs and boxes are individually wrapped by a thin foil-type wrapping material and each is totally sealed from all four sides to preserve tobacco freshness and aroma and to prevent tobacco brittleness if the cigarettes are stored for extended period of time or if the cigarette package is opened but the contents are consumed long time after the opening. The cigarettes are packed in flexible strips having flexible foldings which allow compacting the cigarettes for packaging in the least volume and allow the separation of individual cigarettes without breaking the total seal of any adjacent cigarettes. With the cigarettes sealed inside the strip, the usual aluminum foil-type lining of the cigarette box is no longer needed. The cigarette strips are then packaged inside a soft package or flip-top box having perforated slots on one of its surfaces to allow the easy opening of the package for pulling of one end of the strip for separation of one or more cigarettes for consumption without destroying either the package or the seal of the remaining cigarettes.

2 Claims, 2 Drawing Sheets

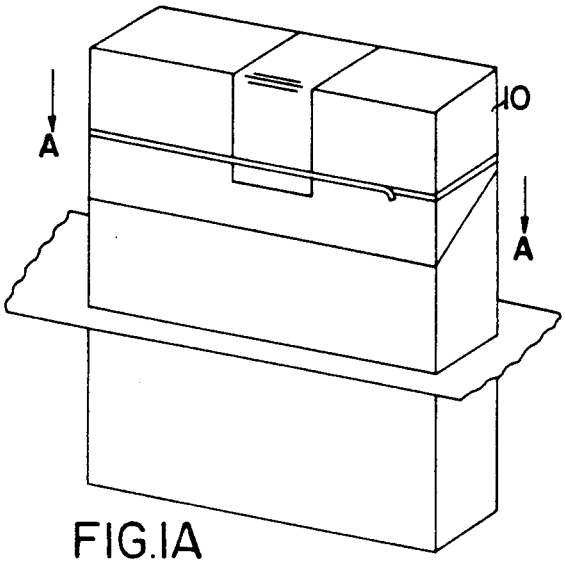
FIG.1A
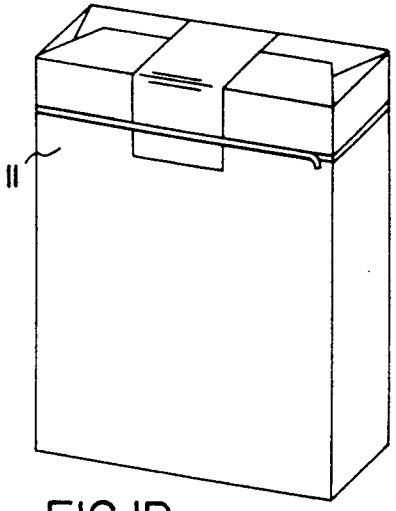
FIG.1B
FIG.1C
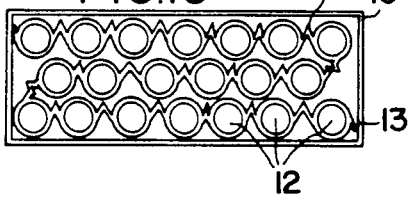
FIG.2D
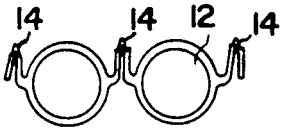
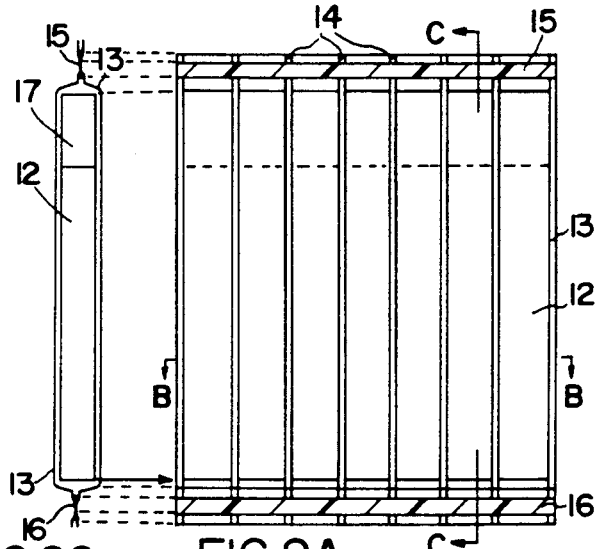
FIG.2C FIG.2A
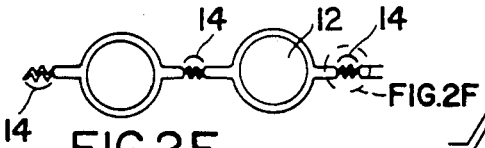
FIG.2E
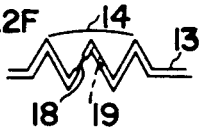
FIG.2F
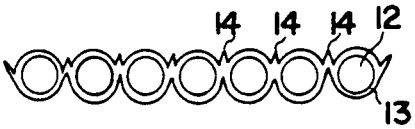
FIG.2B

INDIVIDUALLY WRAPPED CIGARETTES IN CIGARETTE PACK OR BOX

BACKGROUND OF THE INVENTION

Cigarettes in cigarette packages are usually shipped overseas or consumed locally after long months of storage and transportations. It is not unusual that some packages are consumed one or two years after manufacturing. The tobacco in these cigarettes usually loses its aroma and becomes brittle and dry due to the evaporation of its aromic oils. The existing art of individual cigarette packaging offers cumbersome packaging that necessitates elaborate cigarette boxes with serrated knives, or cigarette strips that are hard and rigid. One has always to keep in mind that the more complex or elaborate the package is, the more costly usually it is. The present invention presents a flexible cigarette strip having each cigarette totally sealed, with flexible foldings between each cigarette to allow the sealing and also allow the separation of each individual cigarette without affecting the total seal of each adjacent cigarette. The cigarette strip and the seal folds are made flexible to allow the compacting of the desired number of cigarette in the least volume. The cigarette strip in then packaged inside typical soft package or "hard" flip-top box with provided special perforation which allows the opening of the cigarette package with a gentle pull. The cigarette strip is then pulled and one or more cigarettes are separated from the strip without breaking the seals of the remaining cigarettes and without having to tear or rip-off the cigarette package. The remaining cigarettes are totally sealed and can be stored or consumed long periods after the manufacturing date, without loss to tobacco freshness. The present invention offers improved convenience in an improved package, without the complexity of an elaborate cigarette package. Thus, the present invention yields itself to be more convenient, economic, and therefore, proves to be of more practical use and of more marketing value. The following list provide list of some of the related art of interest:

| | | |
|---|---|---|
| U.S. Pat. No. 1,830,571 | Sullwald, G. | Nov. 03, 1931 |
| U.S. Pat. No. 2,023,542 | Peck, R. L. | Dec. 10, 1935 |
| U.S. Pat. No. 3,107,782 | Jaroff, D. B. et al | Oct. 22, 1963 |
| U.S. Pat. No. 3,165,249 | Peck, S. M. | Jan. 12, 1965 |
| U.S. Pat. No. 3,371,775 | Butler, R. L. | Mar. 05, 1968 |
| U.S. Pat. No. 3,409,721 | Applezweig, N. | Nov. 05, 1968 |
| U.S. Pat. No. 4,109,826 | Maisonneuve, L. V. | Aug. 29, 1978 |

SUMMARY OF THE INVENTION

A cigarette strip which totally encloses and seals each cigarette within, which also has flexible foldings between each cigarette. These flexible foldings contain lines of seals (seams) for sealing the individual cigarette and lines of weakness (perforation) to enable the separation of individual cigarettes.

The strips may be made of soft, flexible foil-type sheets that can preserve the freshness of the cigarette tobacco by not allowing the surrounding air to get through to the cigarettes. The seam sealing the cigarettes can be made by pressure or hot pressing among many other methods applicable, depending on the foil sheet material used. The foil sheets may be of thin aluminum or transparent sulluphane sheets, among other possibilities.

The cigarette strips are then packaged inside soft packs or flip-top boxes, as commonly used. The strips may be packed in one piece containing the desired number of cigarettes in a package, or cut into strips of smaller numbers of cigarettes which then should add up to the designated number printed on the package. These soft and flip-top boxes have lines of weakness (perforation) on their surfaces such as to allow the easy make of an opening on each package through a gentle pull or pushing action. This opening is then used to pull one tip end of the cigarette strip from inside the package. Once the tip end of the cigarette strip is reached, one or more number of cigarettes can be separated from the rest of the strip by pulling along the line of perforation on the strip. The remaining cigarettes are still fully sealed and can be consumed any long time later without loss in tobacco freshness. Also shipments of such packages can be shipped and stored overseas for many months before being consumed with no loss in tobacco freshness.

BRIEF DESCRIPTION OF THE DRAWINGS

FIG. (1A) shows an isometric for the common cigarette box with the flip-top structure.

FIG. (1B) shows an isometric for the common cigarette soft pack.

Figure 3A:
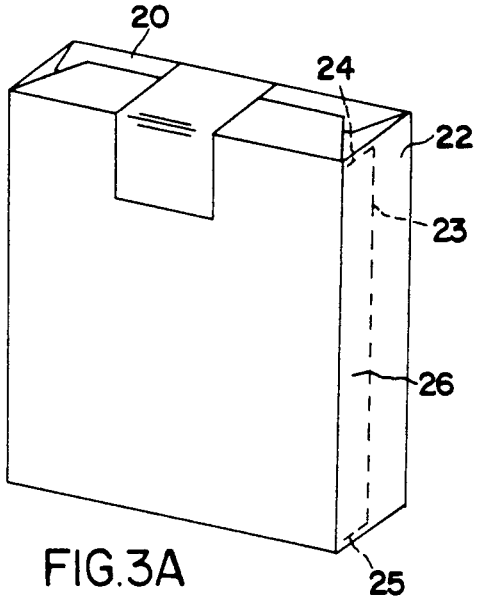
Figure 3B:
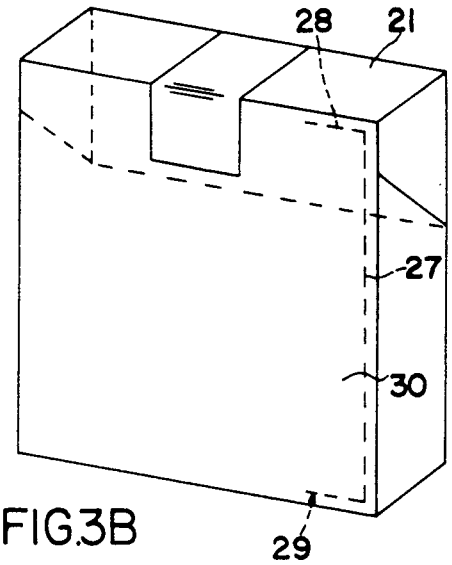
Figure 3C:
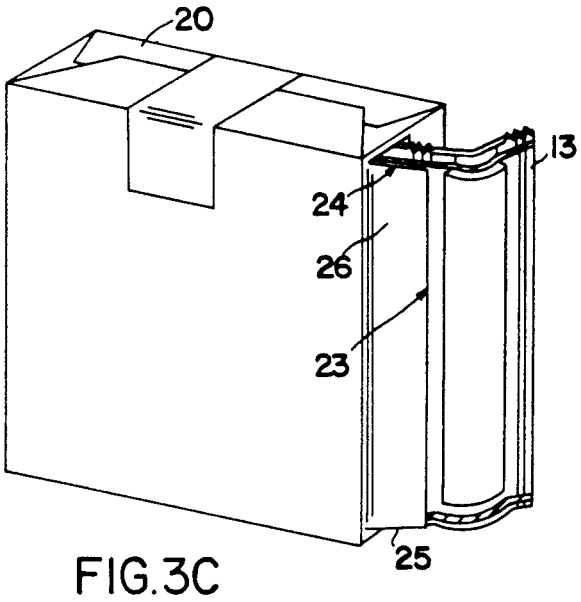
Figure 3D:
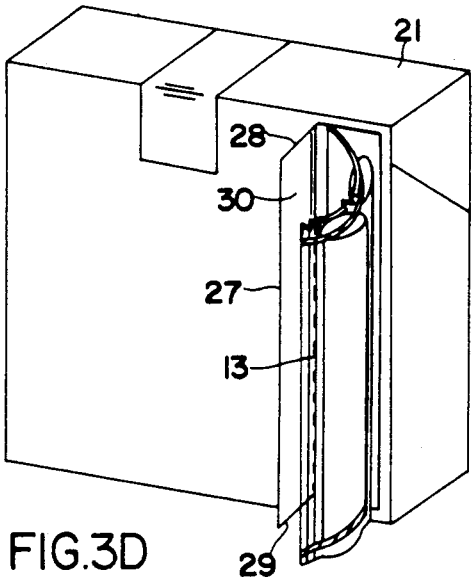

FIG. (1C) shows cross sectional view of FIG. (1A) at the A—A plane.

FIG. (2A) shows frontal view of the cigarette strip, shown outside the cigarette box.

FIG. (2B) shows downward view of FIG. (2A) at the B—B plane.

FIG. (2C) shows side view of FIG. (2A) at the C—C plane.

FIG. (2D) shows an enlargement for details of part of FIG. (2B).

FIG. (2E) shows an expanded (stretched) view of the enlargement of FIG. (2D), showing the flexible and corrugated seam junction.

FIG. (2F) shows details of the corrugated seam junction of FIG. (2E).

FIG. (3A) shows an isometric for the new cigarette soft pack with perforated opening.

FIG. (3B) shows an isometric for the new flip-top cigarette box with the perforated opening.

FIG. (3C) shows an isometric for the new soft cigarette pack, with the cigarette strip shown coming out from the perforated opening.

FIG. (3D) shows an isometric for the new flip-top cigarette box with the cigarette strip shown coming out from the perforated opening.

DETAILED DESCRIPTION OF THE INVENTION

To preserve tobacco freshness of cigarettes for common cigarettes packed in typical cigarette flip-top cigarette box 10 (FIG. (1A)) or soft cigarette pack 11 (FIG. (1B)), each cigarette 12 is wrapped and totally sealed in a thin foil-type paper in a side-by-side form in one continuous strip 13 as shown in FIGS. (1C),(2A), (2B), (2C) and (2D). The cigarette strip 13 may also be cut into 7-cigarette and 6-cigarette patches (or into any other number if so desired) of strips to fill the typical existing cigarette boxes or packs, if so desired.

The cigarette strip 13 is made of thin flexible foil-type sheets of material with enough slack between each two cigarettes to allow: the formation of a seal between each cigarette, the folding of the excess slack material to form flexible folds 14, and to allow a line of perforation to be made for separation of adjacent cigarettes. Two sheets of the foil sheet may cover the top and bottom "surfaces" of the stream of cigarettes and then the two sheets are sealed by appropriate means through at least two seam lines 15 and 16 near the upper and lower ends of the cigarette stream, respectively, as well as along each side of the long side of each cigarette.

FIG. (2A) shows the frontal view of the cigarette strip in a compacted configuration. FIG. (2B) shows a bottom view of the strip as seen from a plane section B—B. The flexible foldings 14 between cigarettes are folded in an accordion-type manner for compactness. FIG. (2C) shows a side view of the strip at plane C—C. Although FIG. (2C) shows a cigarette with filter tip 17, the same design is also applicable to cigarettes without filter tips. In fact, the invention will be of greater value for cigarettes without filter tips where the tobacco becomes more dry and brittle faster than for cigarettes with the filter tip.

FIG. (2D) shows a close-up of two adjacent cigarettes of FIG. (2B), still in the compacted configuration. FIG. (2E) shows the same two adjacent cigarettes in the "stretched" configuration. FIG. (2F) shows an enlargement of the folding between cigarettes, showing the location of the line of seal 18 and the line of weakness (perforation) 19 for the separation of cigarettes. With the cigarettes now enclosed inside the cigarette strip, the usual aluminum foil-type liner used (in the prior art) inside the cigarette boxes and soft packs is no longer needed.

The cigarette strips have then to be packed in packages for retail marketing. To allow for dispensing of the cigarettes, the common cigarette flip top box 10 and the soft pack 11 are herein improved by having lines of weakness (perforations) on one of their surfaces, as shown in the improved flip-top cigarette box 20 of FIG. (3A) and in the soft pack case 21 of FIG. (3B). FIG. (3A) shows the perforations 23 on the smaller side-surface 22 of the box, with the line of perforation being parallel to the longer side of the soft pack, while the shorter lines of perforation 24 and 25 being located near the top and bottom of the shorter side of that soft pack surface. These perforations are intended to allow the opening of the pack by a gentle push, then this opened portion 26 of the surface is then used as a tap to be bent outwards to allow the pulling of the tip end of the cigarette strip. For the 27,28, and 29 are improved flip-top cigarette box 21 similar lines of perforations placed on the back-surface 30 of the box, so as not to interfere with the opening of the box from the top side, if one desires to open the box from the flip-top side instead.

FIG. (3C) shows the soft pack 20 with the opening tap area 26 being opened outwards and a portion of the strip 13 being shown pulled outside the pack. FIG. (3D) shows the flip-top box with the opening tap area 30 being bent outwards and a portion of the cigarette strip being pulled outside the box.

What is claimed:

1. A thin foil-type wrapper for use in packaging common cigarettes in cigarette packs or boxes for preserving tobacco freshness, said wrapper comprising: an enclosure which totally wraps each cigarette individually, said enclosure defined by seam lines forming an individual compartment for each cigarette; a perforation line included in said seam line to permit separation of each individual cigarette while permitting the remaining cigarettes to remain sealed, said seam lines arranged along the long side of each cigarette and defining connecting surfaces between each cigarette which are foldable and flexible; said connecting surfaces defined by a plurality of fold areas so that said connecting surfaces can be compacted linearly and stretched linearly or curvilinearly without separation of adjacent cigarettes.

2. The wrapped cigarette strip of claim 7, said wrapped cigarettes being packaged inside a cigarette pack or box made of thin material, in an appropriate size, with one of its surfaces being perforated along a line parallel to the longest side of the box and also perforated along a short distance along the shortest or the median side near the top and bottom of the cigarette box, such that it allows the opening of the cigarette box through said surface by means of a gentle push to allow said continuous strip of sealed cigarettes to be pulled, separated and used without opening the cigarette box.

* * * * *